US010130156B2

(12) United States Patent
Blake

(10) Patent No.: US 10,130,156 B2
(45) **Date of Patent: *Nov. 20, 2018**

(54) DEODORANT DISPENSER

(71) Applicant: Kickstart Logic, LLC, Kansas City, MO (US)

(72) Inventor: James Blake, Miramar, FL (US)

(73) Assignee: Kickstart Logic, LLC, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/947,500

(22) Filed: Apr. 6, 2018

(65) Prior Publication Data

US 2018/0220772 A1 Aug. 9, 2018

Related U.S. Application Data

(63) Continuation of application No. 15/783,503, filed on Oct. 13, 2017, now Pat. No. 10,051,941.

(60) Provisional application No. 62/408,396, filed on Oct. 14, 2016.

(51) Int. Cl.
*A45D 40/02* (2006.01)
*A45D 40/12* (2006.01)

(52) U.S. Cl.
CPC ..... *A45D 40/02* (2013.01); *A45D 40/12* (2013.01)

(58) Field of Classification Search
CPC .... A45D 40/02; A45D 40/023; A45D 40/026; A45D 40/12; A45D 40/00; A45D 40/0075; A45D 40/04; A45D 40/06; A45D 40/065
See application file for complete search history.

(56) References Cited

U.S. PATENT DOCUMENTS 5,857,793 A * 1/1999 Bossert ..... A45D 40/04 401/134
2008/0095566 A1* 4/2008 Thiebaut ..... A45D 40/02 401/52

* cited by examiner

*Primary Examiner* — David Walczak
(74) *Attorney, Agent, or Firm* — Hovey Williams LLP

(57) ABSTRACT

A deodorant dispenser having a tub including a sidewall and a rim. The sidewall defines an elongated slot. The dispenser also has a platform at least partially circumscribed by the sidewall. The dispenser also preferably includes a projection fixed to and extending outward from the platform through the elongated slot. The projection is moveable within the elongated slot to adjust the position of the platform with respect to the rim.

20 Claims, 6 Drawing Sheets

DEODORANT DISPENSER

RELATED APPLICATION

The current patent application is a continuation of co-pending, identically-titled U.S. patent application Ser. No. 15/783,503 filed Oct. 13, 2017, which claims the benefit with regard to all common subject matter of identically-titled U.S. Provisional Application Ser. No. 62/408,396, filed Oct. 14, 2016. The entirety of each of the foregoing prior-filed applications is hereby incorporated by reference herein, to the extent permitted by law.

BACKGROUND OF THE INVENTION

1. Field

This invention relates generally to the field of deodorant dispensing. More particularly, the invention relates to an improved handheld solid deodorant dispensing tub, cap and other components.

2. Discussion of Related Art

Conventional handheld solid deodorant dispensers come in two notable varieties. The first, and most popular, design includes a rotating member (such as a scroll wheel) located at the base of a main body of the dispenser. Rotating the member about a longitudinal axis of the main body causes the deodorant block to progress upward within the main body, exposing its top above a rim of the main body for application of the deodorant. The second design includes a bottom panel slideable within a main body of the dispenser. Moving the panel toward a rim of the main body causes the deodorant block to progress upward within the main body, exposing its top above the rim for application of the deodorant.

The arrangements of parts used in conventional dispensers for advancing product within their main bodies are flawed. The arrangement in the rotating member-design often does not translate enough force to the product, and/or does not provide sufficient purchase for the application of additional force to dislodge the product from a blockage. The rotating member-design is also subject to the risk of frequent breakage, particularly in popular designs employing knob and threaded-shaft components. The panel design, on the other hand, is not configured for fine adjustment of the product's position, often leading to overcorrection for blockage and even loss of product resulting therefrom. Further, requiring a user to insert an appendage progressively further into the main body of the dispenser from a second open end to move the product nearly always makes for an awkward movement for the user and/or requires turning the main body of the dispenser so that it is difficult to visually track the product's progress toward the rim. Direct but uneven application of force to the panel—particularly near the major axis vertices of an oval-shaped dispenser—may also skew the panel at unintended angles with respect to the main body of the dispenser, increasing the chances of blockage.

SUMMARY OF THE INVENTION

The following brief description is provided to indicate the nature of the subject matter disclosed herein. While certain aspects of the present inventive concept are described below, the summary is not intended to limit the scope of the present inventive concept.

The present inventive concept provides, in its simplest form, a solution to one or more of the aforementioned issues by including a platform movable through a main shaft of a dispenser by a projection extending through a slot in a sidewall of the dispenser.

The aforementioned may be achieved in one aspect of the present inventive concept by providing a deodorant dispenser having a tub including a sidewall and a rim. The sidewall defines an elongated slot. The dispenser also has a platform at least partially circumscribed by the sidewall. The dispenser also preferably includes a projection fixed to and extending outward from the platform through the elongated slot. The projection is moveable within the elongated slot to adjust the position of the platform with respect to the rim.

In another aspect of the present invention, a deodorant dispenser is provided that has a tub including a sidewall defining an open end. The dispenser also has a platform at least partially circumscribed by the sidewall. Further, the dispenser has a cap configured to at least partially cover the open end. The sidewall defines an elongated slot configured to provide mechanical communication between the platform and an exterior of the sidewall. The cap includes a wing sized to extend over at least a portion of the elongated slot and configured to at least partially seal against the sidewall.

Additional aspects, advantages, and utilities of the present invention will be set forth in part in the description which follows and, in part, will be obvious from the description, or may be learned by practice of the present invention.

BRIEF DESCRIPTION OF THE DRAWINGS

Embodiments of the present inventive concept are described in detail below with reference to the attached drawing figures, wherein.

Figure 2:
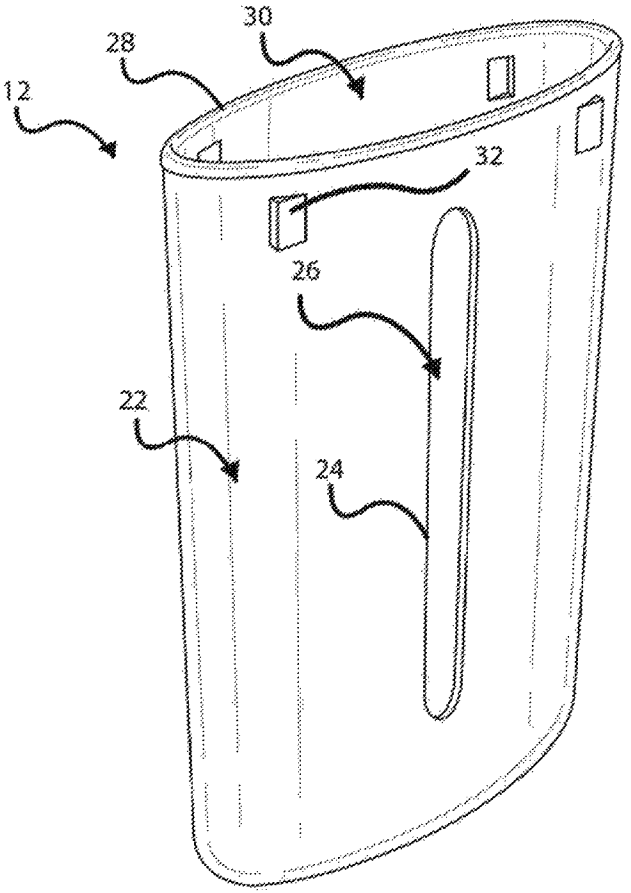
FIG. 2 is an elevated side perspective view of a tub of the dispenser of FIG. 1.

The drawing figures do not limit the present inventive concept to the specific embodiments disclosed and described herein. The drawings are not necessarily to scale, emphasis instead being placed upon clearly illustrating the principles of the present inventive concept.

DETAILED DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1:
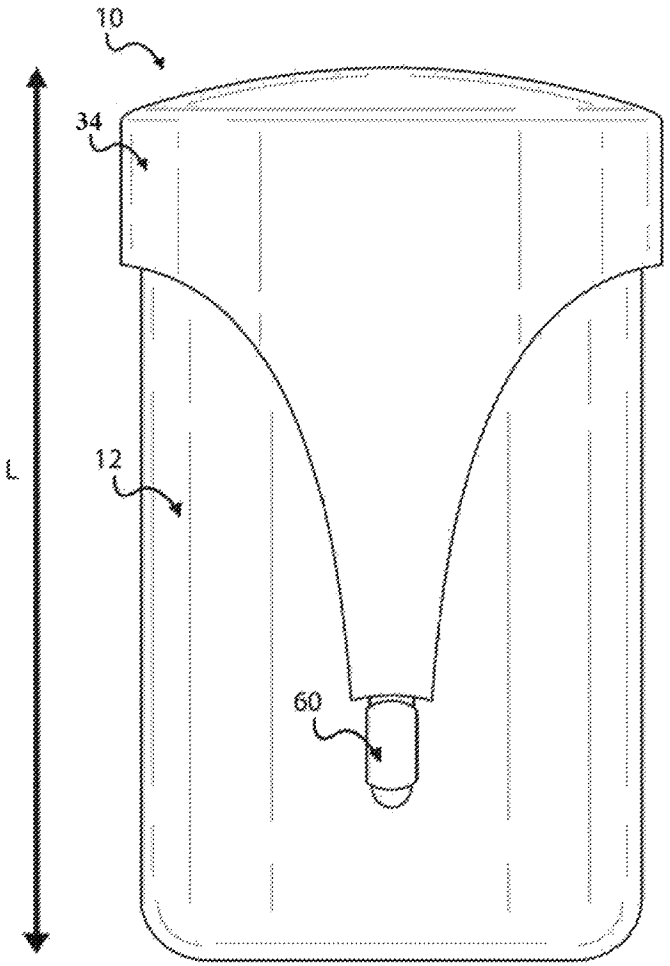
FIG. 1 is a front view of a dispenser according to an embodiment of the present inventive concept.
Figure 4:
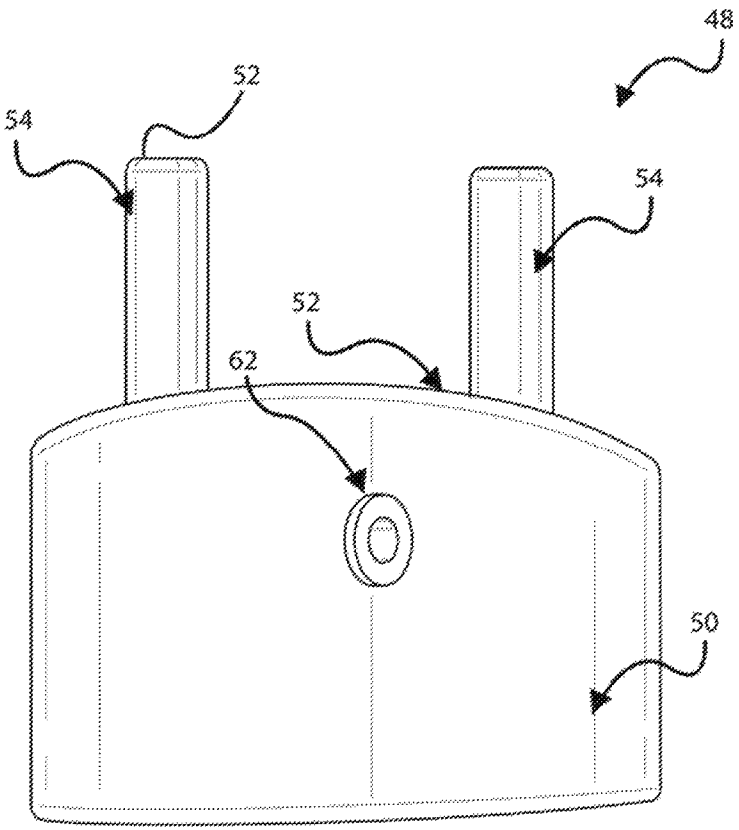
FIG. 4 is a front view of a platform of the dispenser of FIG. 1.
Figure 8:
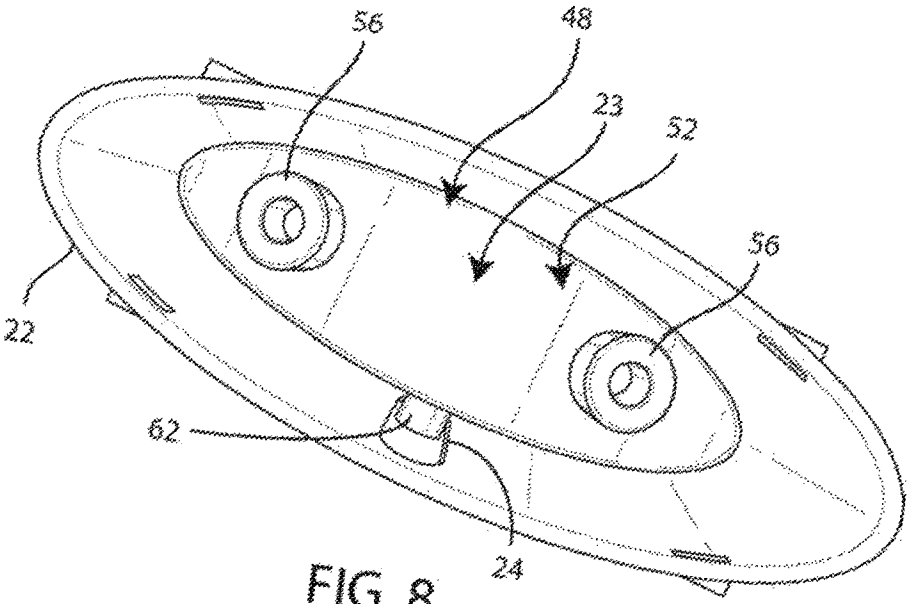
FIG. 8 is a top view of the tub and platform of FIGS. 2 and 4, respectively, illustrating the platform in an at least partially sealing relationship with an inner surface of the tub.
Figure 10:
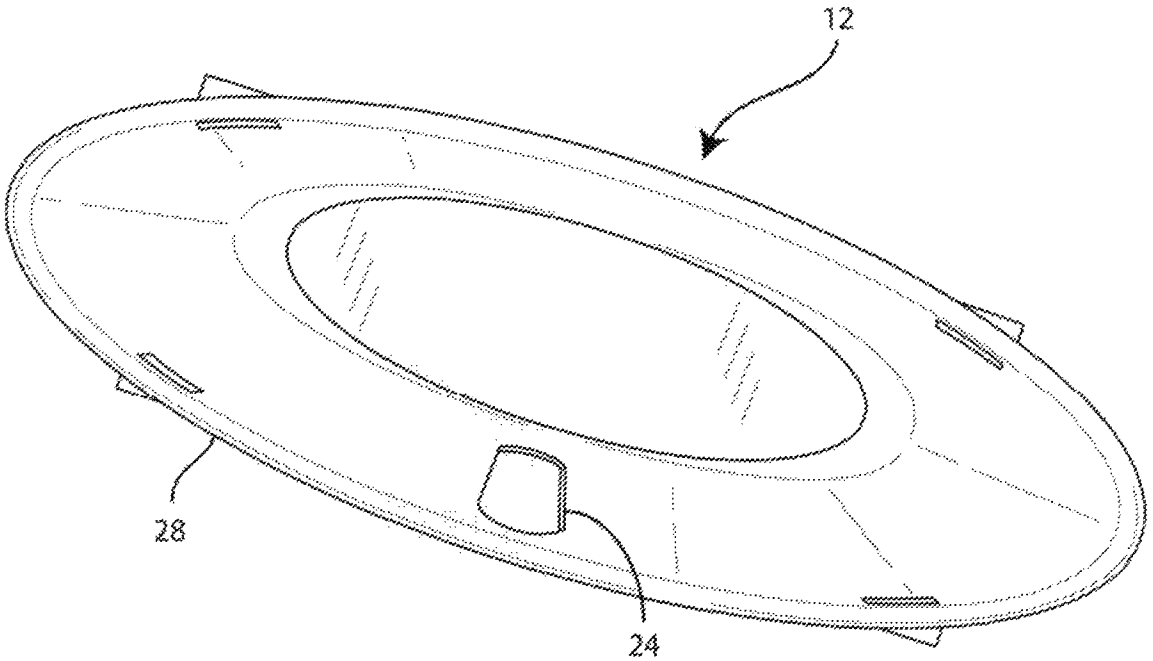
FIG. 10 is a top view of the tub of FIG. 2, sans the platform.

Turning to the Figures, FIG. 1 illustrates a dispenser 10 according to an embodiment of the present inventive concept. The dispenser 10 includes a tub 12 and a cap 34. Cross sections of the tub 12 and the cap 34 are preferably elliptical (see FIG. 8), and may be circular or oval-shaped without departing from the spirit of the present inventive concept. One of ordinary skill will appreciate that a dispenser may also take different shapes within the ambit of the present invention. Moreover, a dispenser may be formed of one or more materials—such as high-density polyethylene, polyethylene terephthalate, polypropylene, polystyrene, or other plastics and materials—without departing from the spirit of the present invention.

Figure 9:
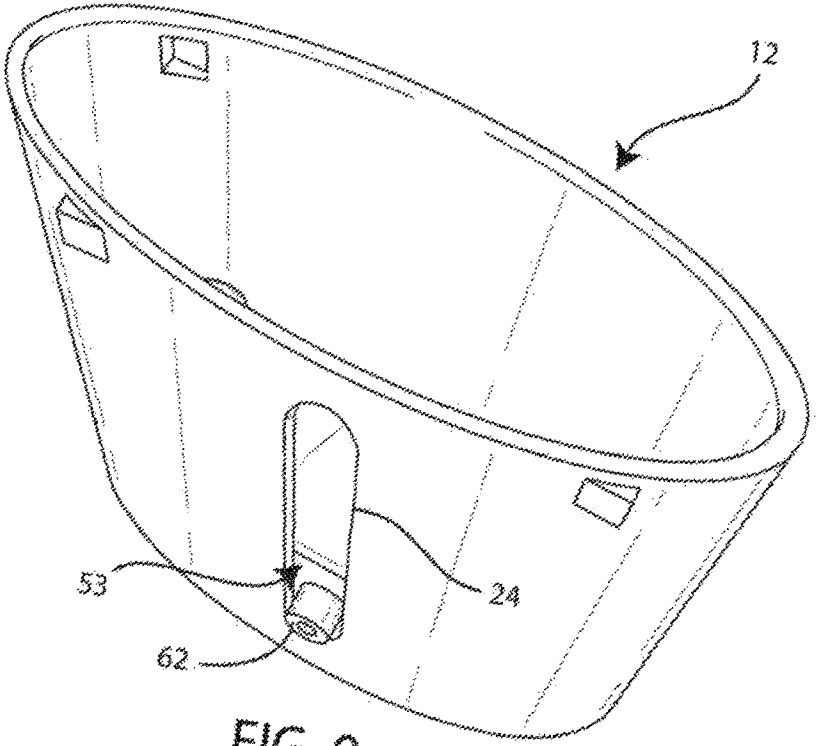
FIG. 9 is a top perspective view of the tub and platform of FIGS. 2 and 4, respectively, illustrating exemplary sizing of a boss fixed to the platform and extending through a slot defined by a sidewall of the tub.

Turning to FIG. 2, the oval-shaped tub 12 is illustrated in additional detail. The tub 12 includes a sidewall 22. The sidewall 22 defines a central shaft 23 of the dispenser 10 (see FIG. 9). The sidewall 22 includes an edge 24 having long segments extending substantially parallel to a longitudinal axis L of the dispenser as well as short, arcuate upper and lower segments offset respectively below and above the top and bottom extremities of the tub 12. The edge 24 defines an elongated slot 26 in the sidewall 22, as discussed in more detail below. It is foreseen that an edge may form other shapes and/or may extend in other directions/orientations along a sidewall without departing from the spirit of the present invention. The tub 12 further includes a rim 28. The rim 28 defines an open end 30 of the tub 12. The tub 12 still further includes four nubs 32 arcuately spaced along an upper portion of the tub 12 proximate the rim 28.

Figure 3:
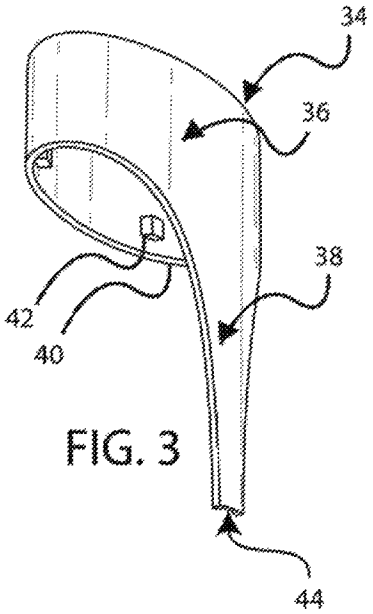
FIG. 3 is a perspective view of an underside of a cap of the dispenser of FIG. 1.
Figure 5:
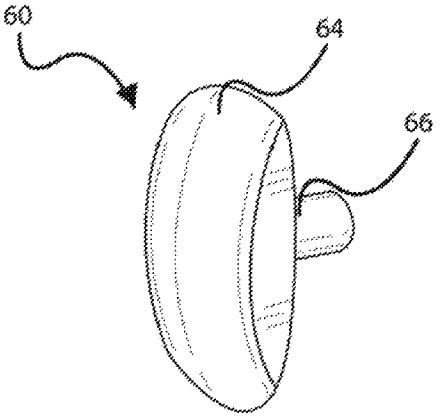
FIG. 5 is a side perspective view of a thumb tab of the dispenser of FIG. 1.
Figure 7:
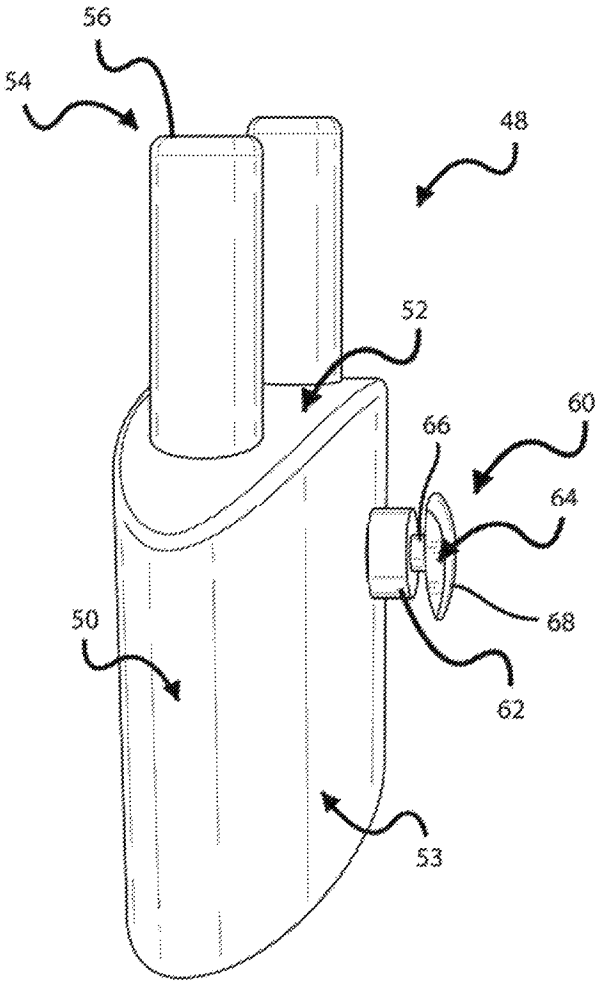
FIG. 7 is a side view of the platform of FIG. 4.
Figure 6:
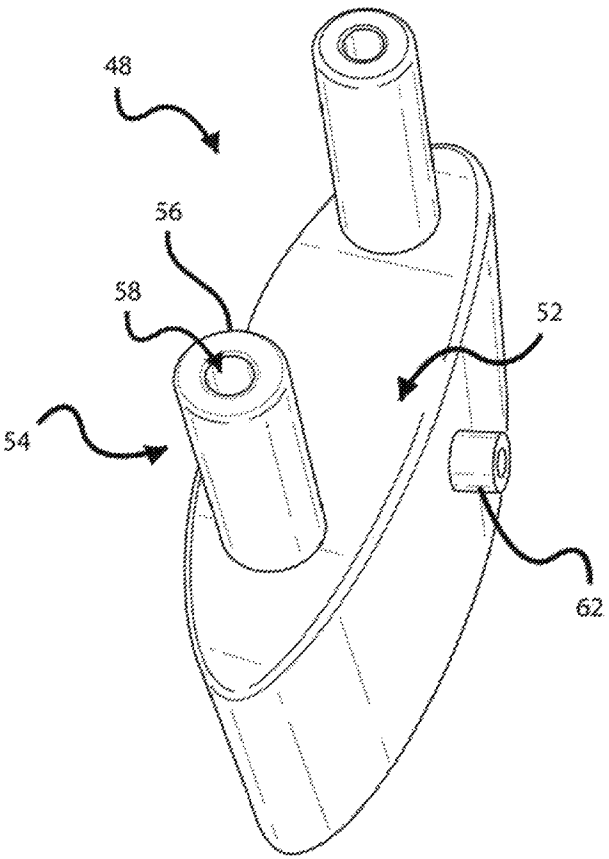
FIG. 6 is an elevated perspective view of the platform of FIG. 4.
Figure 11:
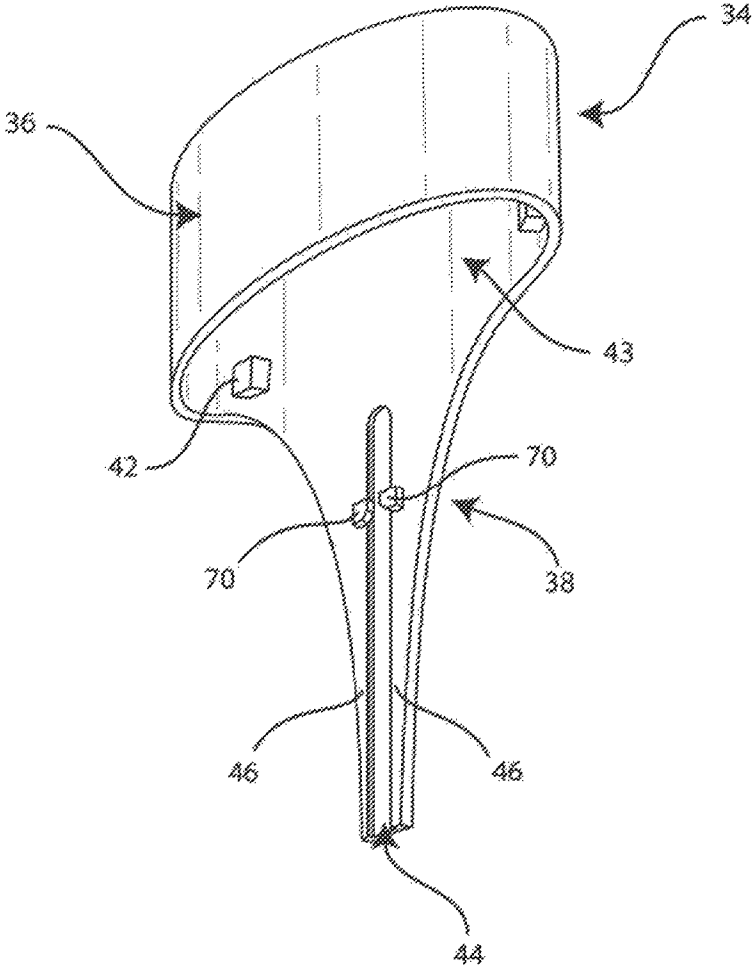
FIG. 11 is a perspective view of the underside of the cap of FIG. 3, taken from an opposite perspective to show an inner surface of a wing defining a groove for receiving the thumb tab and at least partly sealing against the tub; and, FIG. 12 is a partial, cross-sectional top view of the relative dimensions and positioning of the boss, thumb tab, elongated slot and the inner surface of the wing and at least partial sealing relationships formed thereby.

Turning to FIGS. 3 and 11, the dispenser 10 also includes a cap 34 having a main cylindrical section 36 with a wing 38 extending therefrom. The main cylindrical section 36 includes a rim 40 sized to fit over and cover at least a portion, and preferably all, of the rim 28. It is foreseen that a cap may be of various shapes and aspects, and may in certain embodiments omit a wing or flared section, without departing from the spirit of the present invention. Correspondingly, it is foreseen that a rim may be of varying shapes and sizes without departing from the spirit of the present invention.

The cap 34 includes four nubs 42 arcuately spaced along an interior surface 43 of the main cylindrical section 36. The four nubs 42 are shaped as protruded squares to provide complementary surfaces for engaging respectively with the four nubs 32 of tub 12 to releaseably attach the cap 34 to the tub 12. The four nubs 32 are also shaped as protruded squares. More particularly, the nubs 42 of the cap 34 may be located along the interior surface 43 so as to be just below the nubs 32 of the tub 12 when the cap 34 is assembled to and brought to a resting position on the tub 12. With the top of each nub 42 resting adjacent the bottom of each nub 32, the interfaces between these matched nubs 42, 32 provide resistance to removal of the cap 34 from the tub 12, substantially preventing inadvertent separation of the assembly. One of ordinary skill would recognize that more or fewer structures and surfaces, of the same or different shape, may be incorporated into a cap and/or upper surface of a tub for releasably fixing therebetween within the ambit of the present invention, provided that is preferable for structures of the cap to be complementary to the respective structures of the upper surface of the tub.

As perhaps best shown in FIG. 11, an interior surface of the wing 38 preferably includes a groove 44 defined between opposing shoulders 46. The wing 38 and the groove 44 extend substantially the entire length of the elongated slot 26 when the cap 34 is assembled over the tub 12, though a bottom of the wing 38 is offset just above the bottom of the elongated slot 26 in the illustrated embodiment (see FIG. 1). In this configuration, clearance between the bottom of the wing 38 and the bottom of the elongated slot 26 is provided for access to a projection (e.g., a boss, stem and/or thumb tab as discussed in more detail below) extending through the sidewall 22 therebetween, without the need for removing the cap 34. It is foreseen that a wing and/or groove may extend over a greater or lesser portion of an elongated slot and/or may partly or fully cover a projection and/or thumb tab without departing from the spirit of the present invention. It is also foreseen that a groove may be omitted and/or may not be substantially co-extensive with a length of a wing—for example where sealing along a length of the wing is not desired and/or required—without departing from the spirit of the present invention.

Turning now to FIGS. 4 and 6-8, the dispenser 10 also includes a platform 48 circumscribed at least partly, and preferably mostly or entirely, by the sidewall 22. The platform 48 includes a main cylindrical body 50 configured to slide within the central shaft 23 toward the rim 28 for dispensing product. The main cylindrical body 50 of the platform 48 presents an upper, arcuate seating surface 52 configured to support the product, which may, for example, be a block of solid or semi-solid/gel deodorant. The seating surface 52 is preferably curved convexly to improve user comfort nearer the end of a useful life of dispensable embodiments of the dispenser 10, e.g., when portions of a block of product are worn away to reveal segments of the seating surface 52 which may come into contact with the user's body. However, one of ordinary skill would immediately recognize that a seating surface may take on a variety of profiles and shapes, and may support product having a variety of compositions and purposes, within the ambit of the present invention.

Preferably, an outer surface 53 of the main cylindrical body 50 is sized to continuously or intermittently sit flush against an inner surface of the sidewall 22 along at least one cross-sectional plane, at least partially, and preferably substantially, sealing the seating surface 52 from an underside of the platform 48. In certain applications, such sealing may aid in the manufacturing process, as described in more detail below. One of ordinary skill will also appreciate that such sealing is not necessary for all products within the ambit of the invention.

The platform 48 also preferably includes two prongs 54 extending roughly perpendicularly from the seating surface 52. The prongs 54 may include rounded lips 56 for improved adherence of product to prongs 54 and, consequently, to the platform 48 more generally. The prongs 54 may also define interior voids 58 (see FIG. 6) for added product adherence. More particularly, product such as liquefied deodorant slurry may be poured over the seating surface 52 and prongs 54, and into the voids 58, during a manufacturing process and allowed to harden to fill a portion of the dispenser 10 above the seating surface 52. The rounded lips 56 and voids 58 may respectively provide surfaces and volumes over/in which the product may harden, increasing the surface area of adhesion between the product and the platform 48 along the prongs 54 and improving the stability of the block of product. Improved grip of the product on the platform 48 may allow for better movement of product in either direction within the central shaft 23 of the tub 12, and improved stability of the product may reduce premature fragmentation of the product block following moderate use. It is foreseen that more or fewer prongs may be included without departing from the spirit of the present inventive concept.

The dispenser 10 also includes a projection 60 centered laterally—i.e., positioned near a minor axis co-vertex of the oval-shaped dispenser 10—and fixed to the platform 48 along the outer surface 53. The projection 60 extends radially outward through the elongated slot 26 to provide mechanical communication between an exterior of the sidewall 22 and the platform 48. The projection 60 includes a boss 62, which may be fixed to and/or integral with the platform 48, and a thumb tab 64. The thumb tab 64 includes a stem 66 and a head 68. The boss 62 is sized to extend from the platform 48 and through the slot 26 in the assembled configuration. The thumb tab 64 is fixed to the boss 62, and is preferably removable therefrom for each of assembly/disassembly. More particularly, the stem 66 may be inserted into the boss 62 during a manufacturing process, for example following placement of the platform 48 into the central shaft 23, and at least temporarily secured to the boss 62 (see FIG. 12). The head 68 preferably has at least one dimension sized larger than a width of the slot 26 along a lateral or width axis, and provides a relatively broad surface along which a finger of a user may be placed to urge movement of the platform 48 toward or away from the rim 28. It is foreseen that a projection may be of various shapes, and may be assembled or monolithic and/or monolithically formed with a platform, without departing from the spirit of the present invention.

The sidewall 22 may be constructed of a flexible, semi-rigid material permitting the open end 30 and central shaft 23 to be enlarged to receive the platform 48 initially during manufacturing, and to snap back or otherwise return to original resting form once the platform 48 has been fully inserted.

Figure 12:
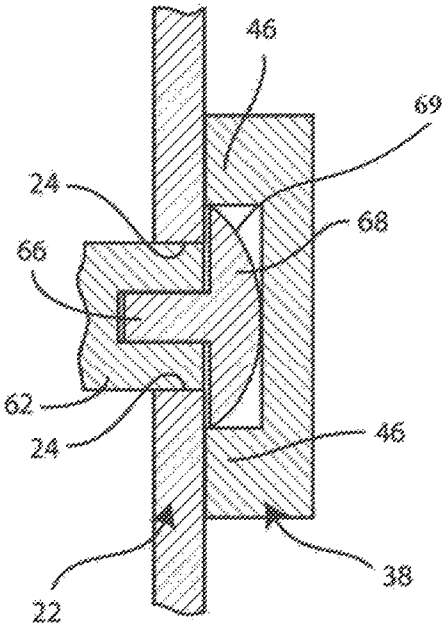

Turning now to FIGS. 11 and 12, the groove 44 is preferably shaped to accommodate an outer margin 69 of the head 68. More preferably, the groove 44 is configured along its length to sit closely adjacent the outer margin 69 as the head 68 progresses upward along the tub 12 over the course of a lifecycle, thereby providing at least a loose or partial seal reducing contaminant entry into the tub 12 along the groove 44 (see FIG. 12). Similarly, the shoulders 46 preferably extend toward and contact the sidewall 22 on either side of the slot 26 to substantially seal thereagainst to protect product inside the tub 12 from exposure to the environment when the cap 34 is in place. Still more preferably, the head 68 sits closely adjacent the outer surface of the sidewall 22 to provide a more complete seal against exposure to the environment when the cap 34 is in place. Advantageously, this configuration may provide a substantial seal against the environment throughout the useful life of disposable embodiments of the dispenser 10, i.e., as the projection 60 gradually progresses toward the rim 28 and the product is intermittently sealed by the cap 34 between uses.

It is preferable, though not required, for the wing 38 to be constructed of a flexible, semi-rigid material permitting the wing 38 to resiliently flex away from the sidewall 22 of tub 12 enough to permit entry of the projection 60 (e.g., thumb tab 64) into the groove 44 as the cap 34 is assembled to the tub 12. Once the groove 44 has received the thumb tab 64 and the main cylindrical section 36 of the cap 34 is substantially in place over the rim 28, the wing 38 may resiliently snap or otherwise return to its original resting position to substantially cover and seal over all or part of the slot 26. It is foreseen that a groove may be omitted from a wing, and that a wing may also or alternatively be spaced slightly away from a sidewall in an assembled configuration to accommodate a thumb tab thereunder, without departing from the spirit of the present inventive concept. A groove presenting a differently-shaped, though preferably complementary, interior surface for accommodating a projection is also clearly within the ambit of the present invention. The wing 38 may also include a pair of stops 70 for catching laterally outermost portions of the head 68 to arrest any further advancement toward the rim 28. A person of ordinary skill will appreciate that one or more stops may be placed in varying positions along the length of a groove within the ambit of the present invention.

The dispenser 10 may also be provided with a temporary barrier (not shown) during the manufacturing process to seal against loss of deodorant slurry from the elongated slot 26, for example, during a curing or hardening process. The barrier may comprise a panel of the sidewall 22 perforated along an outside edge (preferably corresponding to the edge 24) that may be left in place during a curing or hardening process and then removed along the perforated edge to reveal the slot 26. The barrier may also comprise a plastic film or the like placed over the slot 26 during the curing or hardening process and then removed before packaging and shipping, for example. It is foreseen that various temporary barriers may be used without departing from the spirit of the present invention.

Accordingly, the present inventive concept provides a durable solution to at least one of the aforementioned issues by providing an improved dispenser including a tub and cap. The dispenser is configured to contain product that may be dispensed by fine adjustments made along the surface of a sidewall of the tub using, for example, a finger applied to a thumb tab. Such adjustments may be made without awkward movements and at an advantageous angle permitting viewing of the product's progress with respect to a rim of the tub. Moreover, in a preferred embodiment the product may be protected from an ambient environment using a unique wing of a cap for substantially sealing against the sidewall and covering a slot in the tub sized to accommodate a boss and a stem of the thumb tab.

Having now described the features, discoveries and principles of the general inventive concept, the manner in which the general inventive concept is constructed and used, the characteristics of the construction, and advantageous, new and useful results obtained; the new and useful structures, devices, tools, elements, arrangements, parts and combinations, are set forth in the appended claims.

It is also to be understood that the following claims are intended to cover all of the generic and specific features of the general inventive concept herein described, and all statements of the scope of the general inventive concept which, as a matter of language, might be said to fall therebetween.

The invention claimed is:

1. A deodorant dispenser comprising:

a tub having a width and defining an open end and an elongated slot;

a platform at least partially circumscribed by the tub;

a cap configured to cover at least a portion of the open end; and a projection fixed to the platform and extending through the elongated slot to provide mechanical communication between the platform and an exterior of the tub;

wherein the cap includes shoulders defining a groove narrower than the width of the tub and configured to receive the projection.

2. A deodorant dispenser comprising:

a tub defining an open end and an elongated slot;

a platform at least partially circumscribed by the tub;

a cap configured to cover at least a portion of the open end; and a projection fixed to the platform and extending through the elongated slot to provide mechanical communication between the platform and an exterior of the tub; wherein— the tub includes an edge at least partly defining the elongated slot and a rim at least partly defining the open end, the edge includes two long segments, a first short segment defining an upper end of the elongated slot, and a second short segment defining a lower end of the elongated slot opposite the upper end, the dispenser is configured so that movement of the projection between the upper end and the lower end within the elongated slot adjusts the position of the platform with respect to the rim.

3. The deodorant dispenser of claim 2, wherein the cap defines a groove configured to receive the projection.

4. The dispenser of claim 3, wherein the cap includes shoulders extending alongside the groove and at least partially sealing against the tub.

5. The dispenser of claim 3, wherein the projection includes a tab.

6. The dispenser of claim 5, wherein the tab includes a head having a dimension along a width axis greater than a width of the slot.

7. The dispenser of claim 6, wherein the projection includes a boss extending from the platform through the elongated slot and the tab has a stem that is detachably fixed to the boss.

8. The dispenser of claim 2, wherein at least a portion of the cap is sized to extend beyond the upper end in an assembled configuration and to at least partially cover the elongated slot.

9. The dispenser of claim 8, wherein— the tub includes a sidewall having an inner surface, the platform includes an outer surface configured to at least partially seal against the inner surface of the sidewall between the upper end and the lower end of the elongated slot.

10. The dispenser of claim 2, wherein— the tub includes a sidewall having an outer surface and an upper portion, the cap includes an interior surface substantially circumscribing the upper portion, the cap includes a first protruded surface extending inwardly from the interior surface, the tub includes a second protruded surface extending outwardly from the outer surface, the first protruded surface and the second protruded surface comprise complementary surfaces for releasable attachment of the cap to the tub, the second protruded surface being positioned nearer the rim than, and adjacent to, the first protruded surface in an assembled configuration.

11. The dispenser of claim 10, wherein each of the first and second protruded surfaces comprises a nub.

12. The dispenser of claim 11, wherein each of the nubs comprises a protruded square.

13. The dispenser of claim 2, wherein a cross section of the tub forms a generally elliptical shape.

14. The dispenser of claim 2, wherein the platform includes an upper seating surface configured to receive product and a prong extending from the seating surface.

15. The dispenser of claim 14, wherein the prong extends substantially perpendicularly from the seating surface toward the rim.

16. The dispenser of claim 15, wherein the prong defines an interior void and includes a rounded lip at an open end of the prong.

17. The dispenser of claim 16, wherein the seating surface forms a convex shape.

18. The dispenser of claim 2, wherein the projection is centered laterally with respect to the platform.

19. The dispenser of claim 18, wherein— a cross-section of the tub forms a generally oval shape, the projection extends from the platform along a minor axis co-vertex of the oval-shaped tub.

20. The dispenser of claim 18, wherein a cross-section of the tub forms a generally circular shape.

* * * * *